US005630761A

United States Patent [19]

Anderson et al.

[11] Patent Number: 5,630,761

[45] Date of Patent: May 20, 1997

[54] BOWLING BALL RETURN MECHANISM

[75] Inventors: Sean Anderson, Richmond; Larry Gooss, Mechanicsville; Bill Riley, Richmond; Winston Sanders, Chesterfield; Yakov Shmerelzon, Richmond; Michael Stephens, Glen Allen, all of Va.

[73] Assignee: AMF Bowling, Inc., Richmond, Va.

[21] Appl. No.: 615,900

[22] Filed: Mar. 14, 1996

[51] Int. Cl.[6] ..... A63D 5/02

[52] U.S. Cl. ..... 473/110; 473/114; 473/99; 473/111

[58] Field of Search ..... 473/73, 81, 82, 473/86, 89, 90, 91, 94, 95, 96, 97, 98, 99, 106, 110, 111, 114

[56] References Cited

U.S. PATENT DOCUMENTS 3,297,322 1/1967 Ernest et al. ..... 273/43
5,076,582 12/1991 Edwards ..... 273/49

*Primary Examiner*—William M. Pierce

*Attorney, Agent, or Firm*—David E. Dougherty

[57] ABSTRACT

A bowling alley return mechanism includes a horizontal ball return disposed between two adjacent lanes, a pair of side walls which define a chamber and a ball door or opening in one of the side walls. A generally crescent-shaped concave pivotally mounted cradle is disposed within the chamber and adjacent to the opening for receiving a bowling ball thereon. The mechanism also includes an optical sensor which is responsive to a portion of the bowling ball when the bowling ball is on the cradle. A bell crank and linkage rotates the cradle in response to a signal from the sensor. The mechanism also includes an exit door and a releasable locking assembly of the pin and groove type which prevents any flying pins from passing through the exit door. The locking assembly is responsive to an upper portion of a bowling ball when the ball is moved by the cradle to unlock the exit door and allow the ball to pass therethrough and into the horizontal ball return for propulsion to the opposite end of the alley. In addition the mechanism includes an oscillating paddle for removing pins from the chamber and for preventing more than one ball from entering the chamber at the same time.

74 Claims, 10 Drawing Sheets

BOWLING BALL RETURN MECHANISM

FIELD OF THE INVENTION

This invention relates to an improved bowling ball return mechanism for use with a pinspotter in a bowling alley and more particularly to an improved ball handling mechanism for use with a horizontal ball return.

BACKGROUND OF THE INVENTION

A conventional bowling pin and ball handling apparatus is described in the U.S. Pat. No. 3,297,322. This type of apparatus has found widespread use in commercial bowling establishments and includes mechanisms for retrieving both pins and bowling balls from pits behind the bowling alleys, for separation of the pins and returning the balls to bowlers at the approach end of the alley.

Bowling balls leave the pits via openings or doors provided in kickbacks of the bowling alleys. Upon leaving a pit the ball moves into the range of operation of a bowling ball lifting an elevating mechanism, such as an endless belt and track combination which lifts the balls to a runway or return race. The runway is inclined so that the ball rolls down the incline toward the approach end of a lane where the ball is braked and lifted up to a level at which the bowler can conveniently reach it.

A conventional ball elevating mechanism includes a frame and an endless conveyor belt running between two pulleys mounted on a support member. The support member is itself supported by levers and can swing upwardly and away from the track to provide clearance between the belt and track in order to cause initial engagement of the ball by the conveyor belt once the ball has arrived in the vicinity of the belt and the belt is in a lifting position, kicker rollers are required to lift the ball into a position in which it may be engaged by the belt.

A more recent development in bowling ball lifting apparatus is disclosed in the U.S. Pat. No. 5,076,582 of Edwards. As disclosed therein, a conveyor belt is driven by two pulleys mounted on a support rod which is itself pivotal about a rolling pivot in response to an eccentric cam arrangement. This eccentric cam arrangement moves the lower pulley away from the track in order to provide clearance to the ball and then moves the lower pulley toward the track so that the belt securely engages the ball and moves it up the track. An oscillating paddle is driven by a spherical cam arranged on a speed reduction pulley which also drives the eccentric cam arrangement so that the paddle and elevator mechanism moves in synchronism via a common drive. The apparatus disclosed by Edwards provides a relatively simple elevator belt tensioning mechanism, and uses a paddle drive clutch mechanism and ball elevator track of the previous development without requiring substantial modifications.

While the ball elevating mechanism disclosed in the aforementioned patents are shared by two alleys, a mechanism is necessary for preventing balls from moving through the openings from the pits simultaneously. The conventional ball handling apparatus uses a paddle which is pivotal between openings to permit only one ball at a time from entering the elevator and to prevent pins from entering.

In order to operate properly the ball handling mechanism should be arranged to compensate for balls having weights generally ranging from 6 to 16 lbs, while rejecting stray pins, which weigh less than 4 lbs. As a result the paddle drive and kicker rollers require pressure sensitive mechanisms each of which must fit into a space approximately the width of a bowling ball.

While such mechanisms have proven to be effective, the mechanisms involved are nevertheless relatively complicated and relatively slow in returning a ball to the bowler.

A more recent development in ball return systems is a horizontal ball return wherein a ball is fed to a conveyor belt which accelerates the ball and propels it down the alley i.e., down a ball return trough. In such systems the pins and balls are separated by a filter or a door. The door system which is typically horizontal, is susceptible however to frequent stoppages due to pins bypassing the door. In such systems a pin may trigger the door opening or follow a ball into or through the door, thereby interfering with the return system. Because of this problem there are frequent shut downs due to pin jams. Such shut downs obviate any benefits of a faster return mechanism.

It has now been found that a bowling ball return system in accordance with the present invention offers a number of advantages over the prior art. For example, the ball return system disclosed herein eliminates or greatly reduces pin jams which are caused by stray pins entering into the ball return mechanism. To be more specific, the ball return mechanism according to the present invention eliminates problems associated with a horizontal door being jammed by a pin. The mechanism also includes means for preventing the initiation of a cycle due to a flying pin striking any portion of the mechanism and until a bowling ball is in proper position for a return.

It has also been found that the mechanism in accordance with the present invention returns a bowling ball from the pit to the bowler in less time than the prior art returns. For this reason a bowler does not have as long to wait for the return of his ball. Consequently, the game is speeded up so that more games per hour are bowled. This also reduces waiting time for those bowlers who are waiting to bowl and at the same time increases a bowling center's return on investment.

It is presently believed that there is a large commercial market for bowling ball return mechanisms according to the present invention and that such mechanisms or systems can be manufactured and sold at a competitive price. In addition, the mechanisms are durable, relatively easy to install and service and can be used to replace existing ball return mechanisms of the ball elevating or horizontal type.

BRIEF SUMMARY OF THE INVENTION

In essence, a bowling ball return mechanism in accordance with the present invention is designed for use with a pin spotter or the like. The ball return mechanism includes a pair of side walls which define a chamber and a cradle disposed within the chamber for receiving a bowling ball thereon. At least one of the side walls defines an opening adjacent to the cradle for allowing a bowling ball to pass therethrough and into contact with the cradle. In a preferred embodiment of the invention, the bowling ball rolls onto the cradle and is supported by the cradle at the bottom and rear portion of the ball. A sensor is also disposed between the two side walls for producing a signal when a bowling ball is in contact with i.e. supported by the cradle. The mechanism also includes means such as appropriate linkage for moving the cradle in response to a signal from the sensor. Means such as a front or exit door and a releasable locking assembly are also provided for maintaining the exit door in a closed position until released by movement of the ball in response to movement of the cradle. This door and locking arrangement further reduces the likelihood of a jam in the return mechanism.

In the preferred embodiment of the invention, a bowling ball return mechanism returns spent bowling balls from two adjacent lanes at one end of a bowling alley to the opposite end thereof. The mechanism includes a horizontal ball return disposed between the two adjacent lanes. The horizontal ball return includes an entrance area, an exit area, and means for projecting a bowling ball along the length of the bowling alley disposed between the ball entrance area and the ball exit areas. The mechanism also includes means defining a chamber between the lanes and adjacent to the ball entrance area. This chamber has a pair of sidewalls each of which defines an opening of sufficient size to allow a bowling ball to pass therethrough. A concave cradle which is adapted to receive a bowling ball thereon and thereagainst is positioned within the chamber and adjacent to the openings for receiving a bowling ball from either of the lanes. This cradle is constructed and arranged so that it supports a bottom portion and a portion of one side of the bowling ball. A sensor which is responsive to an upper portion of the bowling ball when the bowling ball is supported by the cradle is also disposed within the chamber i.e. between the two side walls. This sensor produces a signal when a bowling ball is supported and/or positioned by the cradle. The mechanism also includes means for moving the cradle in response to a signal from the sensor to move the ball slightly upwardly and toward the entrance area. Exit door means are also disposed between the side walls adjacent to and between an opposite side of the bowling ball and the ball entrance area. In addition, a releasable locking means maintains the exit door means in a closed position to prevent any fallen pins which enter into the chamber from being pushed forward into the ball entrance area. The mechanism also includes means for releasing the locking means in response to contact by the bowling ball as the ball is moved toward the entrance area. The ball passes through the exit door means, into the entrance area of the horizontal ball return and is propelled thereby along the length of a bowling alley. The preferred embodiment of the invention also includes means such as an oscillating paddle for preventing more than a single bowling ball from entering the chamber at any given time.

The ball return mechanism in accordance with the preferred embodiments of the invention includes a multi-faceted defense against pin jams which are caused by flying or falling pins entering into the ball return mechanism. For example, an exit door which separates a ball handling subassembly and the horizontal ball return prevents flying pins from entering the horizontal ball return. In addition a novel locking assembly locks the exit door in a closed position so that even if struck with the full force of a flying pin, it would deflect the pin back towards the cradle for removal by an oscillating paddle. The locking assembly or its activating element is also responsive to the size and shape of a bowling ball as for example the upper surface thereof which further reduces the likelihood of the locking assembly being unlocked by a flying pin.

The ball return mechanism according to the present invention also includes additional means for preventing jams due to fallen pins. For example, a sensor which is responsive to the size and/or geometric shape of a bowling ball actuates a cradle to move a bowling ball toward the horizontal ball return. Since the sensor which may include a time delay circuit to prevent activation by a flying pin, senses the size and/or geometric shape of a bowling ball, the cradle is only actuated when a bowling ball is positioned for movement toward the horizontal ball return. In the preferred embodiment of the invention, the sensor has a line of sight which passes through an upper portion of a bowling ball. Thus, when one or more fallen pins are in the area of the cradle, they will not break the line of sight of the sensor and will not actuate the mechanism.

Furthermore, a crescent-shaped cradle, includes a pair of rearwardly and downwardly extending side walls which close the ball doors or openings as the cradle moves a bowling ball toward a horizontal ball return. In effect, the cradle closes the ball door as it moves forward to prevent flying pins from entering the mechanism behind the cradle. Finally, an oscillating paddle sweeps any fallen pins out of the chamber. This multi-faceted approach essentially eliminates problems due to pin jams.

The invention will now be described in connection with the accompanying drawings wherein like reference numerals have been used to designate like parts.

DETAILED DESCRIPTION OF THE PREFERRED EMBODIMENTS OF THE INVENTION

FIGS. 1–5 show the various elements of a bowling ball return mechanism according to a preferred embodiment of the invention. As shown, the ball return mechanism can be used with any type of bowling pinspotting machine or bowling installation in which the kickback of a bowling lane is provided with an opening or ball door through which a ball may roll out of the pit and into the range of operation of a bowling ball return mechanism. This return mechanism subsequently returns the ball along a bowling ball return runway to the approach end of a bowling lane. As used herein, a bowling lane is that portion of an alley which is bounded by an approach section, a pin deck and a pair of gutters, while the term alley refers to the combination of those elements.

The mechanism disclosed herein is an improvement over the bowling ball lifting apparatus of U.S. Pat. No. 5,076,582 which is incorporated herein by reference. That reference discloses a paddle mechanism for preventing more than one bowling ball from entering the return mechanism at the same time and also sweeps any fallen pins which may have entered into the ball return area out of the area. This paddle mechanism is essentially identical to the paddle which is used in the preferred embodiment of the present invention.

Figure 1:
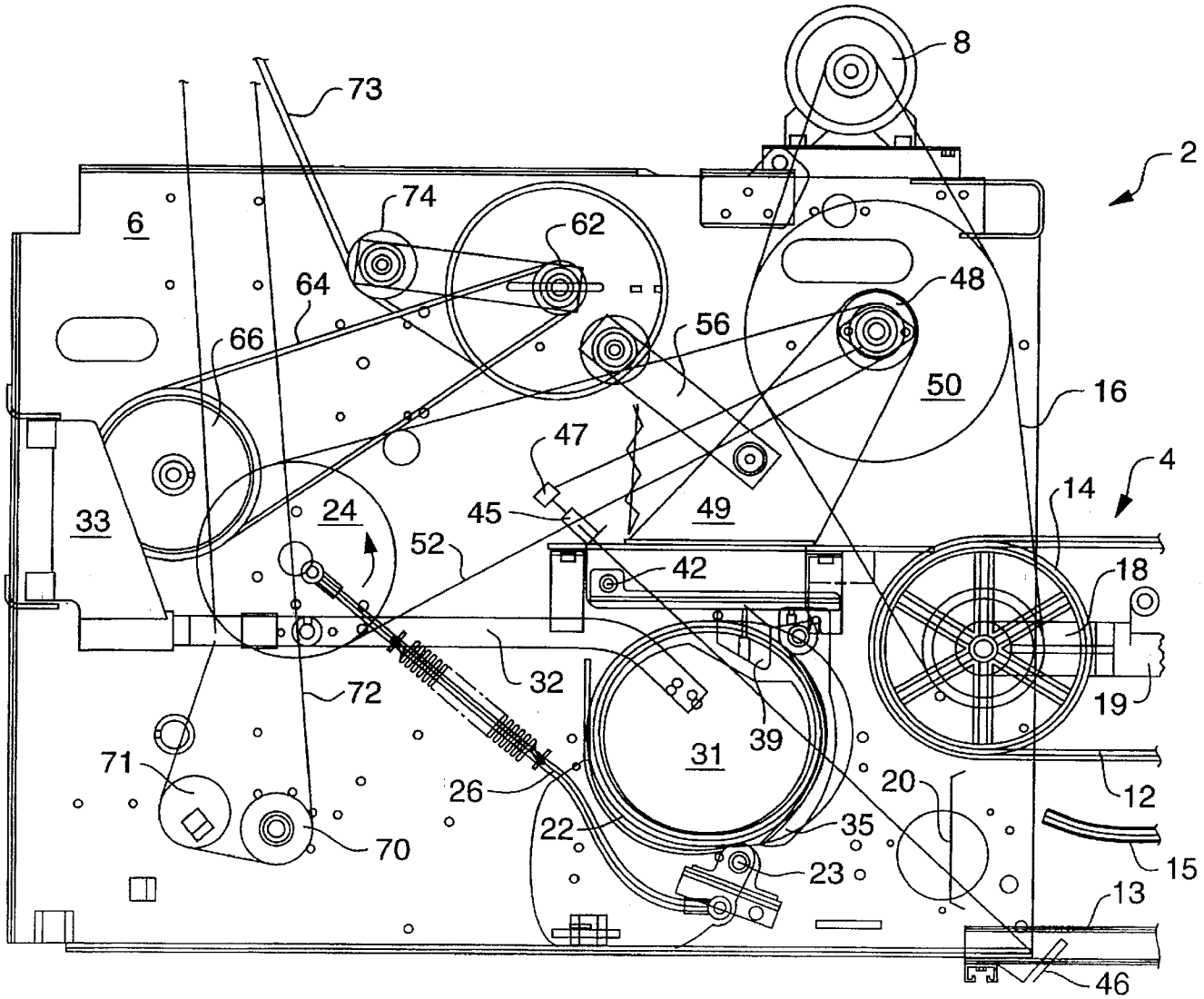
FIG. 1 is a side view illustrating the ball return mechanism in accordance with a preferred embodiment of the invention.

FIG. 1 is a side view with an outside wall removed to illustrate the various elements of a bowling ball return mechanism 2. As illustrated, the various elements of a ball handling subassembly are disposed between a pair of side walls 6–6' (only one of which is shown in FIG. 1). The sidewalls 6–6' define a chamber for holding the subassembly. Other elements such as a horizontal ball return 4 and motor 8 may be disposed on the outside of the chamber or extended outwardly therefrom, as in the case of the horizontal ball return 4. For example the horizontal ball return 4 may extend into the chamber between sidewalls 6–6' for receiving a bowling ball from the ball handling subassembly and then propelling the ball toward the approach section of an alley. The horizontal bowling ball return mechanism 4 includes an endless belt 12, a track 13 and a bowling ball guide 15 which maintains the bowling ball on the track 13. This subassembly is designed for receiving a bowling ball thereon and therebetween. The belt 12 accelerates a bowling ball as it rolls along the track 13 by frictional engagement between the ball and the belt 12. Thus, it is important that pressure be applied by the belt supporting mechanism to maintain a firm contact between the ball and the belt 12.

Figure 11:
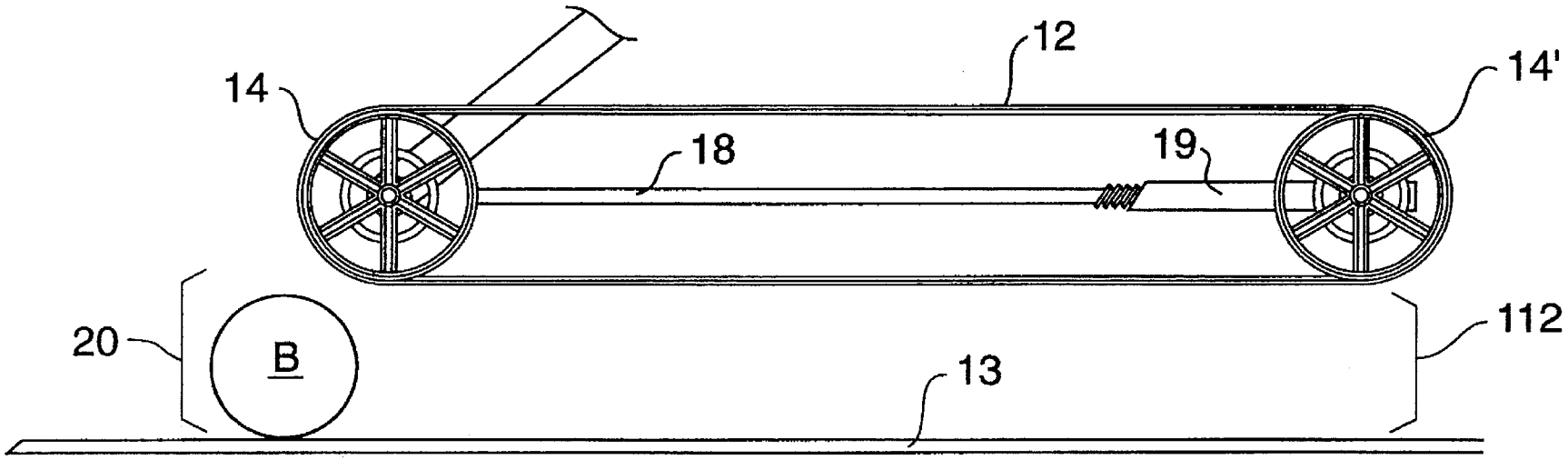

The belt 12 is moved and supported by two pulleys 14 and 14' (only one of which is shown in FIG. 1) which are rotatably mounted on an elongated tubular support member 18 (see FIG. 11). The support member 18 includes a tensioning mechanism 19 for biasing the pulleys 14 and 14' away from each other to thereby provide tension on the belt 12. The tensioning mechanism 19 is of a conventional design which will be well understood by a person of ordinary skill in the art.

Figure 2:
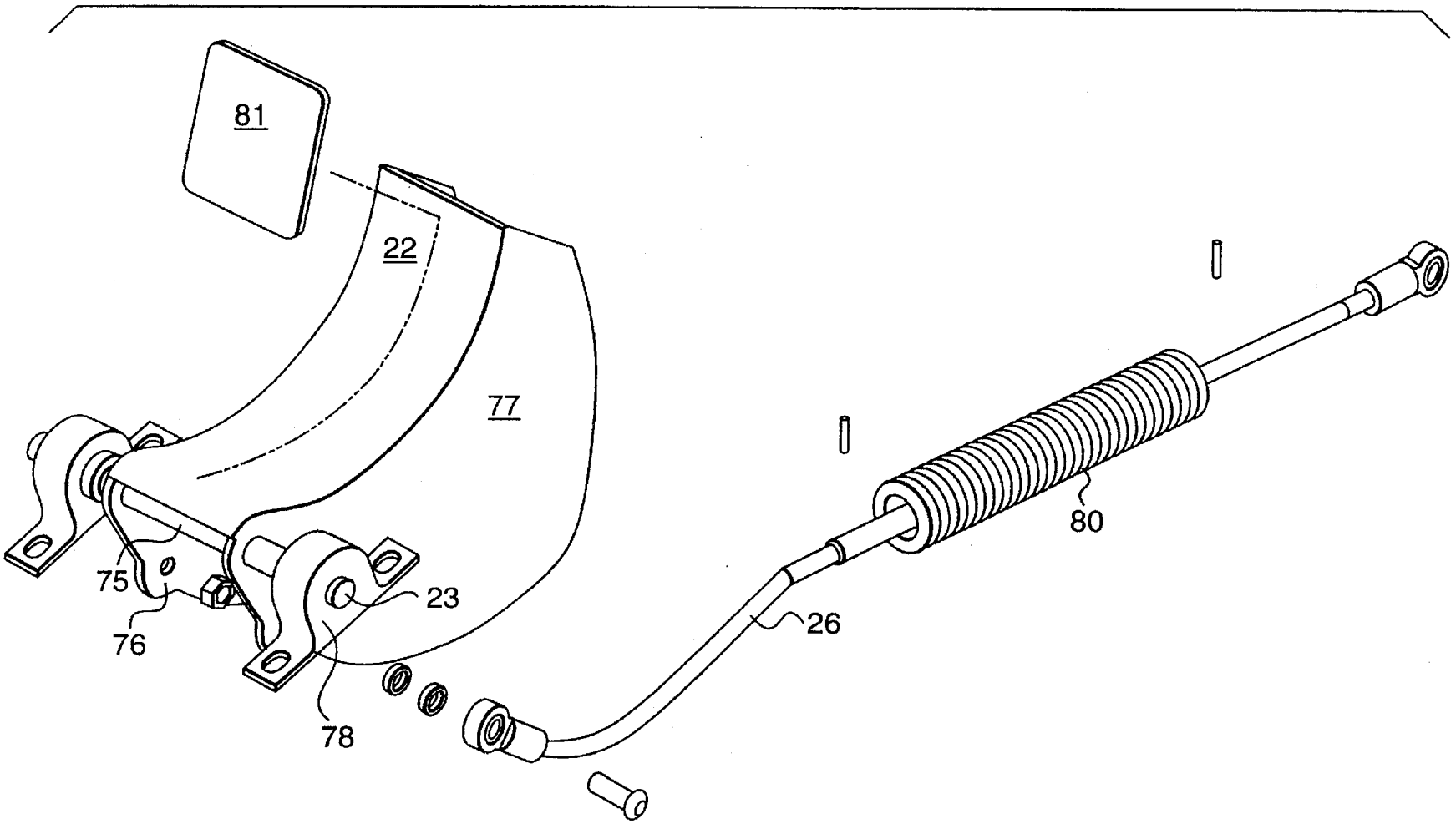
FIG. 2 is a perspective view showing a pivotal cradle assembly and drive linkage used in the ball return mechanism shown in FIG. 1.

The ball handling subassembly is disposed adjacent to the horizontal ball return 4 and is constructed and arranged to deliver a bowling ball to an entrance area 20 of the ball return 4. The entrance area 20 is defined as the area between the belt 12 and track 13 where a bowling ball enters the horizontal ball return. The subassembly also includes a ball contacting member such as a concave or crescent shaped cradle 22 which is shown more clearly in FIG. 2. This cradle 22 is designed to receive a bowling ball thereon and to support the bottom and rear surface of a bowling ball as illustrated in FIG. 2. The cradle 22 is also designed to prevent pins from entering the ball return area as will be described hereinafter. While a bowling ball is spherical in shape, the bottom portion refers to that portion of a ball which is resting on the cradle 22 while the rear portion refers to the part of a ball which is away from the horizontal ball return and which rests against an upwardly extending portion of the cradle 22.

In a preferred embodiment of the invention, the cradle 22 is pivotally mounted within sidewall 6–6' on a pivot 23. This pivot 23 is positioned below the bowling ball and toward a forward portion of the bowling ball. The cradle 22 and a bowling ball resting thereon are lifted upwardly and forwardly by means of a crank pulley 24 and linkage 26, as will described in more detailed in connection with the operation of the mechanism.

Each of the sidewalls 6–6' (see FIG. 5) include a ball opening or ball door 30 through which bowling balls leave the pit and enter into the range of operation of the bowling ball return mechanism in a conventional manner. The opening 30 is adjacent to the cradle 22, so that a bowling ball which is delivered by the pit assembly (not shown) through the opening 30 rolls onto the cradle 22. This positioning of the bowling ball is assisted by a pair of ball door rings which will be described in connection with FIG. 4.

A paddle 31 that fits within the circumference of ball openings 30 oscillates back and forth between the two openings to prevent a second bowling ball from entering into the ball return mechanism when a first bowling ball is entering the area. The paddle 31 is connected to a support rod 32 which is pivotal about a vertical axis with a ball sensor mechanism 33. This ball sensor mechanism is mechanical in nature and conventional and incorporated in other ball return systems. See for example the aforementioned U.S. Pat. No. 4,076,582. The paddle mechanism also includes a mechanical light ball sensor as will be well understood by those skilled in the art.

The ball return mechanism also includes a pivotally mounted exit door 35 which is disposed adjacent to the ball opening and side walls 6–6' and between the cradle 22 and the horizontal ball return 4. As shown, the exit door 35 is pivoted from the upper portion thereof about a rod 36 so that it swings forwardly toward the horizontal ball return 4 and upperwardly as it opens in response to a bowling ball being pushed through the door 35 as the bowling ball is moved forwardly by the cradle 22 and/or downwardly due to gravity. A locking assembly including a locking member 38 which locks the door 35 in a closed position to prevent any flying pins from entering the horizontal ball return or otherwise jamming the mechanism is also provided. The locking member 38 and door 35 also prevents any pins which had fallen onto the cradle 22 from being delivered to the horizontal ball return 4.

The locking member 38 is disposed between the side walls 6–6' and above the cradle 22. The locking member 38 also includes a downwardly extending contact element 39 and a laterally extending groove 40 (see FIG. 3) which is constructed and arranged to engage a rod or locking pin 41 to maintain the exit door 35 at a closed position. This prevents flying pins from entering the horizontal ball return.

The locking member 38 is preferably pivotally mounted above the area which is occupied by a bowling ball when the ball is on the cradle 22. Then as the cradle 22 pivots about pivot 23, it moves the bowling ball upwardly and forwardly so that an upper surface of the ball engages or strikes the contact element 39. As the ball moves upwardly, the locking member 38 is moved pivotally about pivot 42 to thereby separate the groove 40 from a locking pin 41.

An optical sensor 45 is mounted above the locking member 38 with a line of sight which passes through a space which is occupied by a portion of a bowling ball when the ball is on the cradle 22 or positioned for return. An alternative sensor arrangement includes a plurality of sensors which are adapted to respond to the geometric shape and size of a bowling ball in order to distinguish a bowling ball over one or more pins which might land on the cradle. The optical sensor 45 is of a conventional design as for example, a Banner Series S18 retroflector sensor which is available from Banner Engineering Corp., of Minneapolis, Minn. Such sensors may incorporate a mirror 46. The sensor 45 has a line of sight which passes through an opening 47 in the exit door 35 and detects the presence of a bowling ball when a portion of the surface of the ball interrupts the light beam. Having the line of sight passing through an upper and forward position of a bowling ball further reduces the likelihood of the line of sight being broken by a flying pin.

The sensor 45 produces a signal when a bowling ball is within its line of sight and by means of a suitable circuit 47 actuates a clutch 48 which is then driven by an outer drive pulley 50. This outer drive pulley 50 is continuously rotated by means of a motor 8 acting through a drive belt 16 which also powers the pulley 14 of the horizontal ball return 4. The circuit may be of any suitable design as for example those used in conveyor controls. Such circuits are well within the capabilities of a person of ordinary skill in the art. In the preferred embodiment of the invention the suitable circuit means 47 is based on a time delay so that the passing of an oscillating paddle or flying pin will not actuate the mechanism. Time delay circuits are well known and well understood by persons of ordinary skill in the art.

Upon receiving a signal from the sensor, the clutch assembly 48 is engaged and rotates the crank pulley 24, by means of a belt 52, approximately ¾ of a revolution to thereby move the linkage 26 which causes the cradle 22 to rotate about pivot 23. This pivotal movement of the cradle 23 and movement of a bowling ball is illustrated in more detail in FIGS. 8, 9 & 10. As shown in FIG. 1 the pulley 50 and clutch 48 are supported by a bracket 49 which also supports a conventional belt tension device 56 for maintaining tension on the drive belt 52.

The oscillating paddle 39 is driven by means of pulley 60 and clutch 62 which may be rotated by a separate source of power (not shown). The clutch 62 has a conventional mechanical override as will be well understood by those skilled in the art. The clutch 62 rotates a belt 64 to thereby rotate the pulley 66 to provide oscillating movement to the paddle 31 in a conventional manner.

A separate drive means including a pair of pulleys 70 and 71 and an endless belt 72 are also shown in FIG. 1. This drive means rotates a pit carpet (not shown) through pulley 70 and may also be connected through a belt 73 for rotating the pulley 60 for moving the paddle 31. A conventional belt tensioner 74 maintains tension on the belt 73.

As shown more clearly in FIG. 2, the cradle 22 defines a cup or crescent shaped but flat surface and is pivotally mounted on a rod 75 which defines the pivot point 23. The cradle 22 also includes a pair of downwardly and rearwardly projecting sidewalls 76 and 77 which prevent flying pins from entering into the chamber behind the cradle surface as the cradle 22 moves a bowling ball towards the horizontal ball return. As shown in FIG. 2, the rod 75 is positioned between two mounting members 78 and 79 and passes through a lower forward portion of the cradle 22. The lower forward portion refers to the portion of the cradle which supports the bowling and that portion which is relatively close to the horizontal ball return. The linkage 26 also includes a coil spring 80 or overload mechanism to prevent serious damage to the system if the cradle 22 becomes jammed. Also shown is a wear pad 81 which may be applied to the surface of the cradle 22.

Figure 3:
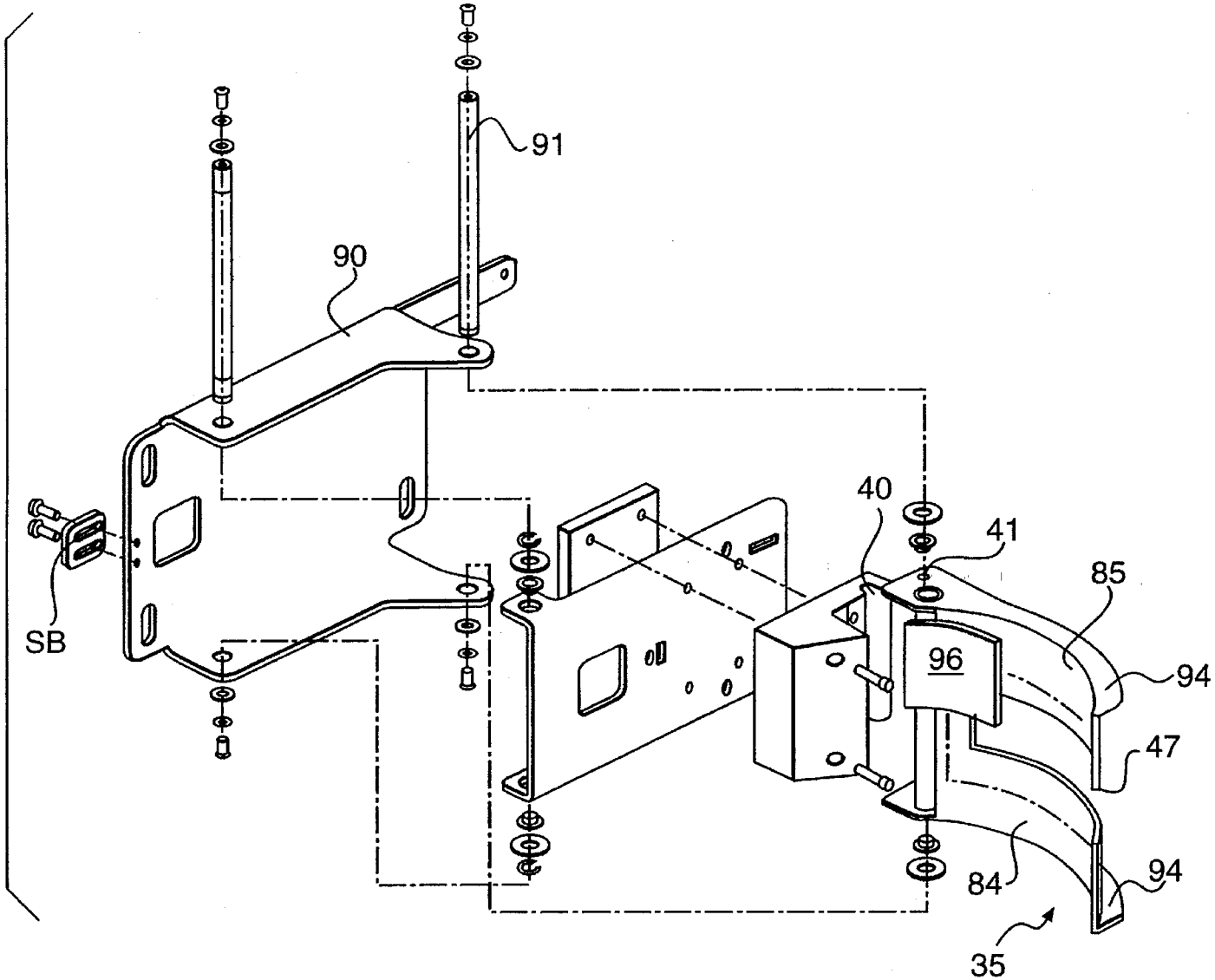
FIG. 3 is an exploded perspective view illustrating a front or exit door assembly and a door locking assembly in accordance with a preferred embodiment of the invention.
Figure 7:
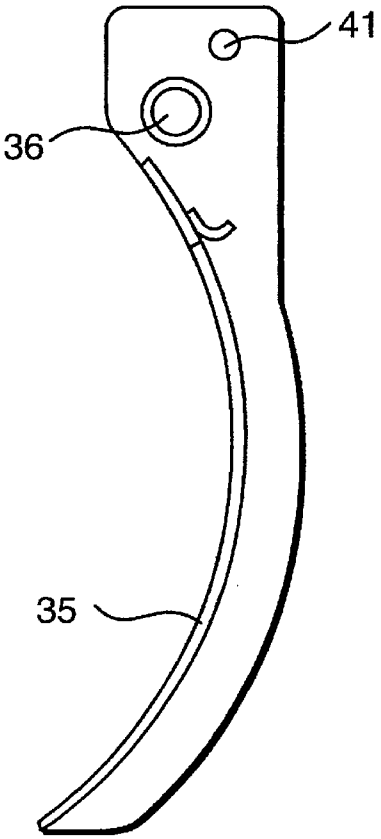
FIG. 7 is a side elevational view of the exit door shown in FIG. 6.
Figure 6:
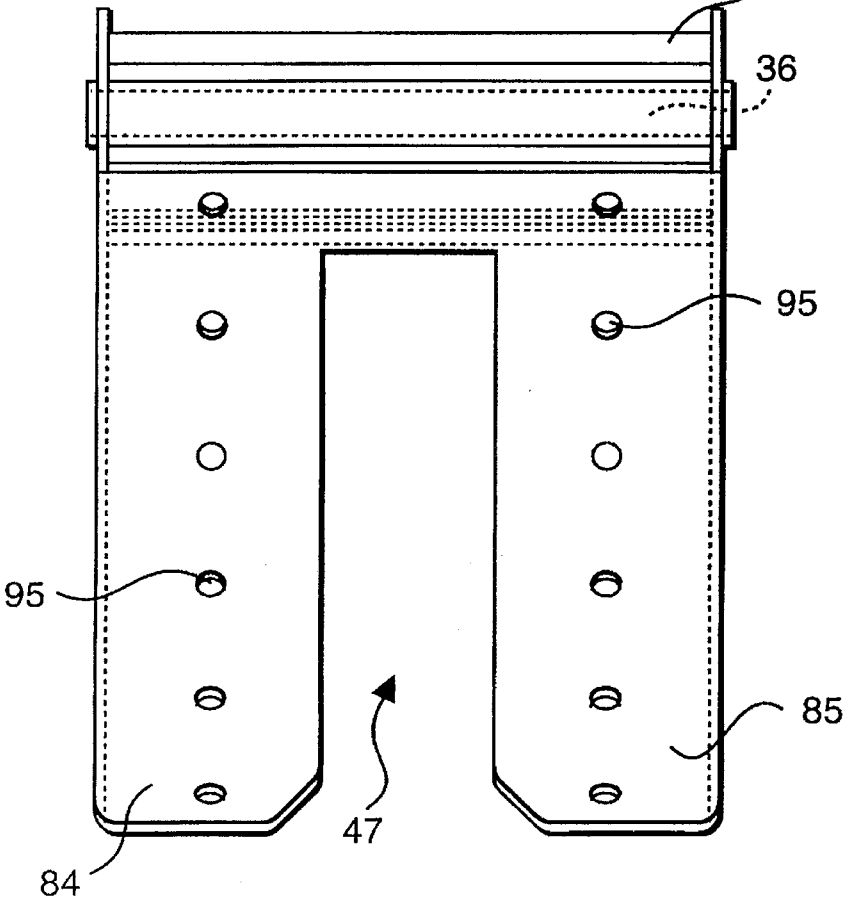
FIG. 6 is a front view of an exit door which is incorporated in a preferred embodiment of the invention as shown in FIGS. 1–5.

The exit door 35 and locking member 38 of the preferred embodiment of the invention are shown in more detail in FIG. 3 as shown therein the exit door 35 which is also shown in FIGS. 6 and 7 defines an opening or channel 47 which is bounded by two downwardly extending rectangular portions 84 and 85. As shown the door 35 has a generally C-shaped cross section which approximates the curve of a bowling ball.

Figure 4:
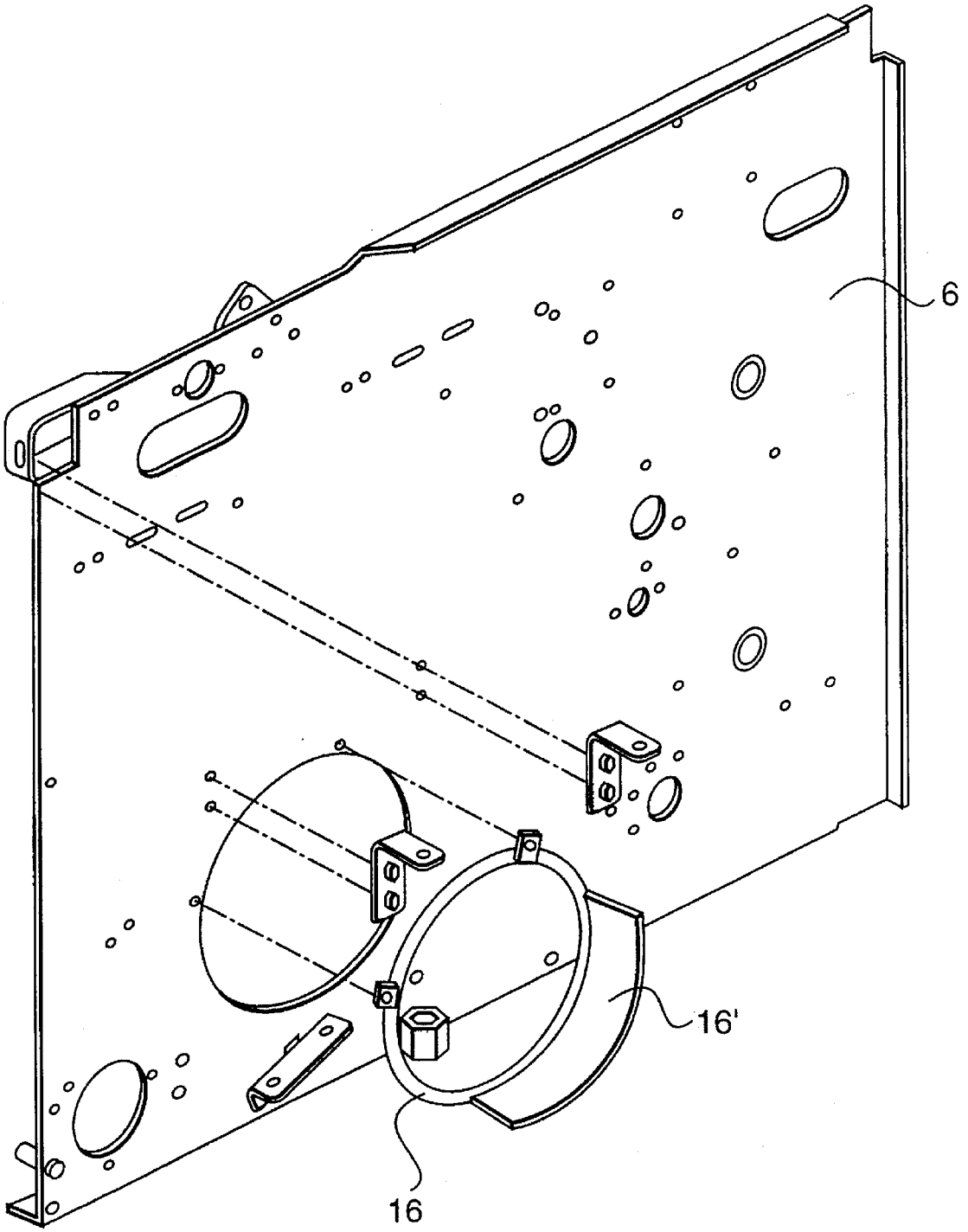
FIG. 4 is a perspective view of a side wall and ball opening as used in the preferred embodiment of the invention.
Figure 5:
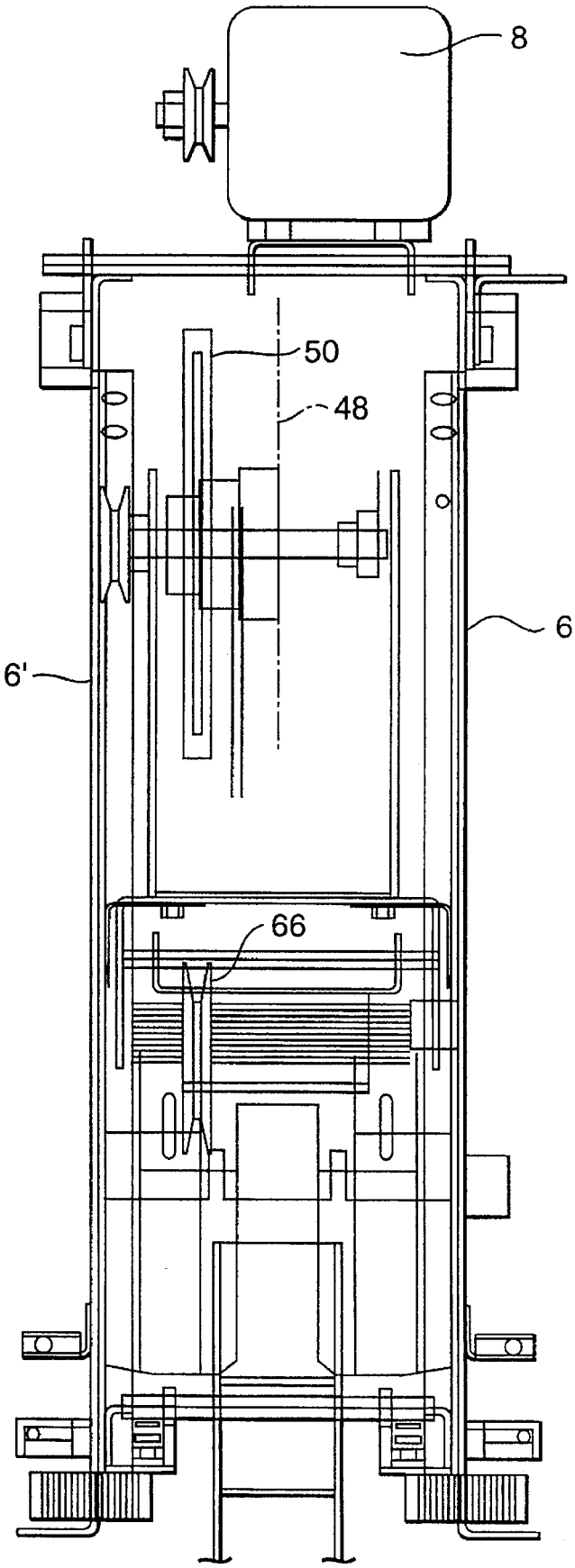
FIG. 5 is an end view of a ball return mechanism shown in FIG. 1.

FIGS. 4 and 5 show the side walls 6–6' which define a chamber therebetween. As shown in FIG. 4 the side wall 6 includes an opening or ball door in a lower portion thereof. This opening is of sufficient size to allow a bowling ball to roll through the opening and into the chamber. As illustrated a ball door ring 16 includes an inwardly extending base element 16' in a lower portion thereof. In a preferred embodiment of the invention the inwardly extending base element 16' has a relatively slight downward slope that extends inwardly toward the cradle 22. The second side wall 6' (not shown in FIG. 4) includes an essentially identical structure so that the base element 16' of each side are adjacent the cradle 22 and form a generally cup shaped receptacle for positioning a bowling ball on the cradle 22. The door ring 16 and inwardly extending elements 16' are designed to drop the bowling ball onto the cradle 22.

Figure 8:
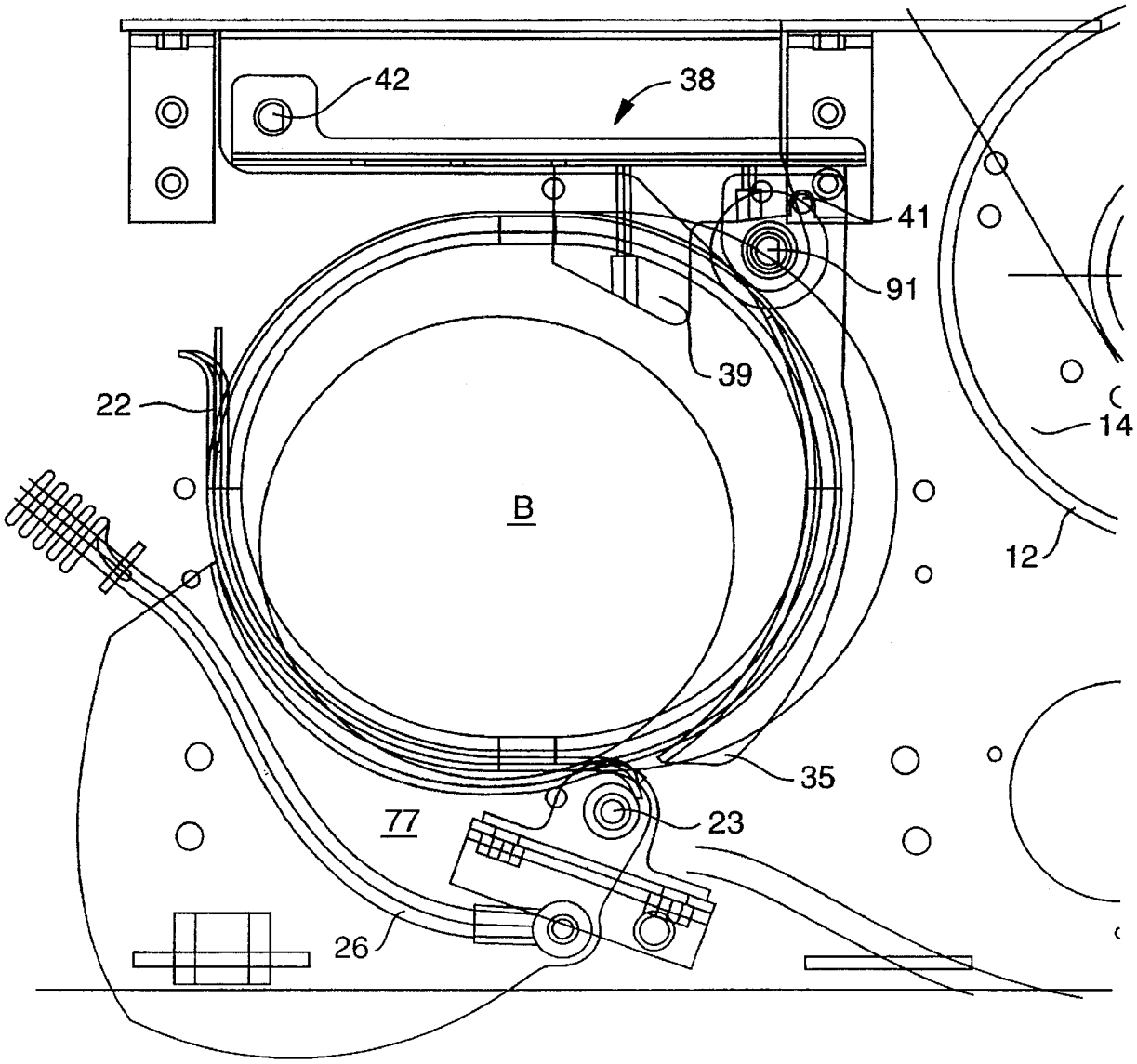
FIG. 8 is a side view illustrating the pivotal cradle assembly, exit door and locking assembly with a bowling ball in a first position i.e., resting on the ball cradle.
Figure 9:
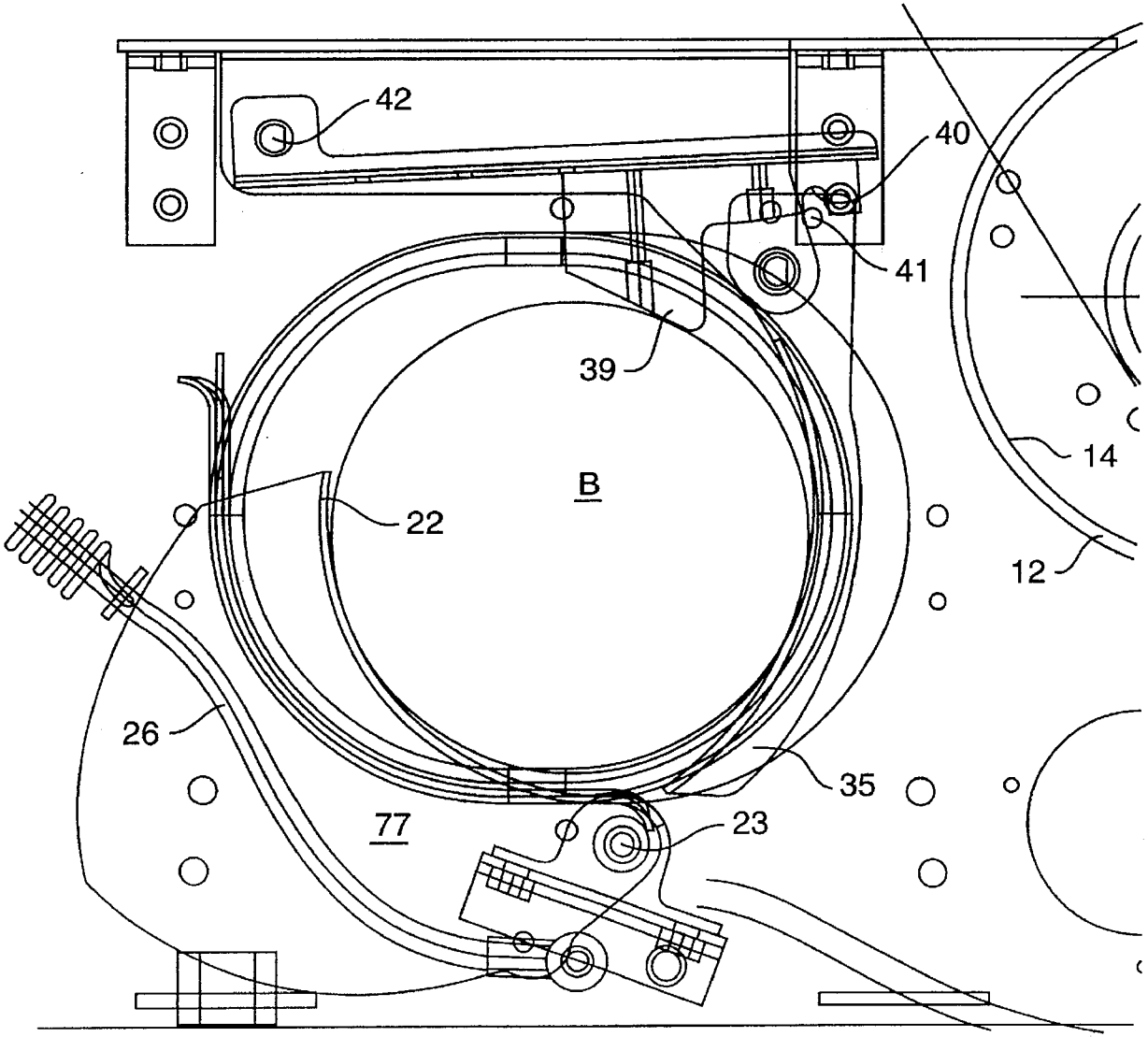
FIG. 9 is a side view illustrating the pivotal cradle assembly, exit door and locking assembly with a bowling ball in a second or partially lifted position.
Figure 10:
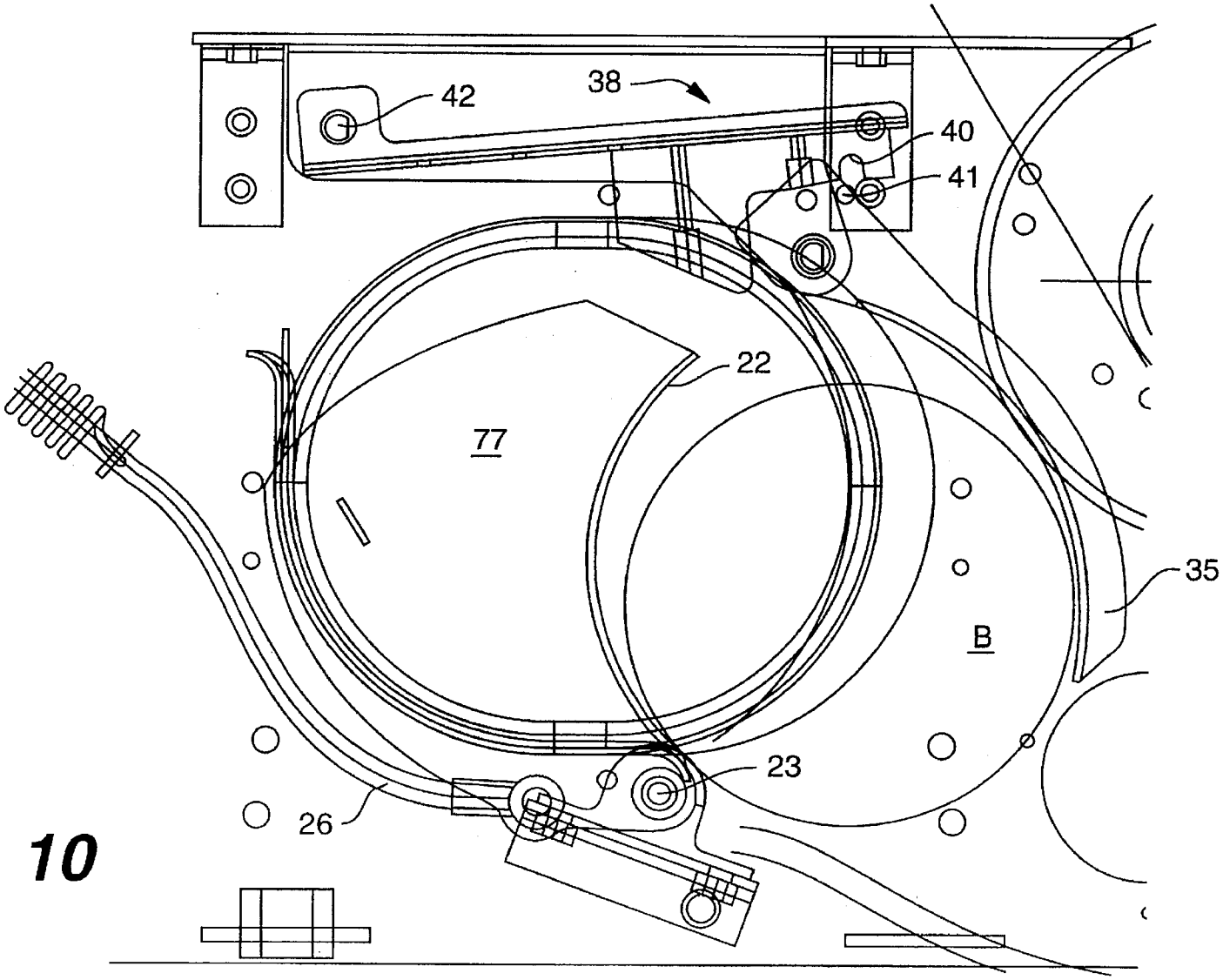
FIG. 10 is a side view illustrating the pivotal cradle assembly, exit door and locking assembly with a bowling ball in a third position i.e., with the exit door partially open; and, FIG. 11 is a schematic view illustrating a horizontal ball return mechanism.

FIGS. 8, 9 and 10 illustrate the movement of a bowling ball B from its position within the chamber i.e., upon the cradle 22, as it is elevated and moved forward into contact with the exit door 35 and as it is passing through the exit door and into the entrance area 20 of the horizontal ball return 4. As shown in FIG. 8 the bowling ball B is resting on the cradle 22 with the door 35 in a closed position. In this position, the locking assembly 38 is in the locked position with the locking pin 41 engaged by the groove 40. The locking pin 41 and groove 40 prevent rotation of the door 35 about a pivot or rod 91. As illustrated, the spacing between the bowling ball B and exit door 35 are such that there is insufficient space for a flying pin to become wedged between the ball and the exit door.

In FIG. 9, the cradle 22 has been rotated by means of a linkage 26 in response to a signal from the sensor. The cradle 22 lifts the bowling ball B upwardly into contact with the contact element 39 to rotate the locking member 38 about the pivot 42. Rotation of a locking assembly 38 lifts the groove 40 out of engagement with the locking pin 41 to thereby unlock the door 35. As shown in FIG. 9 the door 35 remains in a closed position.

FIG. 10 shows the bowling ball as it is being pushed through or falls through the exit door 35 which has been rotated about the rod 91. As illustrated the ball B is falling forward and off of the cradle 22, through the exit door 35 and onto a downwardly sloping track way 110 which delivers the ball to the entrance area of the horizontal ball return 4 (shown schematically in FIG. 11). It should be recognized, that for many installations, the ball will be delivered directly into the entrance area of the horizontal ball return in which case, the downwardly sloping trackway will be eliminated.

As shown in FIG. 11, the horizontal ball return 4 includes an endless belt 12, and track 13. The horizontal ball return also includes a pair of pulleys 14 and 14' with the endless belt 12 in engagement with and passing around the pulleys 14 and 14'. The entrance area 20 is defined as that point where the bowling ball is supported by the track 13 and is first engaged by the belt 12. The ball B is then accelerated along the track 13 by the belt 12 and leaves the horizontal ball return at an exit area 112.

While the invention has been described in connection with its preferred embodiments, it should be recognized that changes and modifications can be made therein without departing from the scope of the appended claims.

What is claimed is:

1. A bowling ball return mechanism for use with a pin spotter comprising a pair of side walls defining a chamber and a cradle disposed within said chamber for receiving a bowling ball thereon, means defining an opening in one of said sidewalls adjacent to said cradle for allowing a bowling ball to pass therethrough and into contact with said cradle and a sensor for sensing that a bowling ball is in contact with said cradle, means for moving said cradle in response to the sensing by said sensor, exit door means for preventing pins from being delivered to a ball return and a releasable locking assembly means for maintaining said exit door means in a closed position until released by contact with the ball in response to movement of said cradle.

2. A bowling ball return mechanism for use with a pin spotter in accordance with claim 1 wherein said releasable locking assembly is released by an upper surface of a bowling ball coming into contact therewith as the ball is moved by said cradle.

3. A bowling ball return mechanism comprising a horizontal ball return having a ball entrance area, a ball exit area and means for propelling a ball along the length of a bowling alley disposed between said entrance and exit areas, said mechanism also including a pair of side walls defining a chamber and a concave cradle disposed within said chamber for receiving a bowling ball thereon, means defining an opening in one of said side walls for allowing a bowling ball to pass therethrough and into contact with said cradle and a sensor for indicating that a bowling ball is in contact with said cradle, means for moving said cradle in response to an indication by said sensor, exit door means for preventing pins from being delivered to a ball return and a releasable locking member for maintaining said exit door means in a closed position until released by movement of the ball in response to movement of said cradle so that the ball passes through said door means and into said entrance area for propulsion along the length of a bowling alley.

4. A bowling ball return mechanism in accordance with claim 3 which includes pivot means adjacent to said cradle and wherein said means for moving said cradle rotates said cradle about said pivot means.

5. A bowling ball return mechanism in accordance with claim 4 in which said locking member is disposed above said cradle so that it is contacted by an upper surface of the bowling ball as the ball is moved by said cradle to thereby unlock said exit door means.

6. A bowling ball return mechanism according to claim 5 in which said concave cradle defines a curved surface having a crescent-shaped cross-section.

7. A bowling ball return mechanism according to claim 6 wherein said concave cradle includes a pair of side walls extending rearwardly from said crescent-shaped surface for preventing pins from passing through the opening in the side walls as a bowling ball is being moved by said cradle.

8. A bowling ball return mechanism according to claim 7 wherein said locking member is pivotally mounted.

9. A bowling ball return mechanism according to claim 8 in which said exit door means includes a locking pin and wherein said locking member includes a groove for engaging said locking pin.

10. A bowling ball return mechanism according to claim 9 which includes an oscillating paddle means between said pair of side walls for preventing more than one bowling ball from entering said chamber at the same time and for removing any fallen pins from said chamber.

11. A bowling ball return mechanism according to claim 3 which includes a clutch assembly means which is responsive to a signal from said sensor for activating said cradle.

12. A bowling ball return mechanism in accordance with claim 11 in which includes a pivot means, crank pulley and linkage connecting said cradle to said crank pulley through said pivot means whereby rotation of said crank pulley moves said cradle about said pivot means.

13. A bowling ball return mechanism according to claim 3 in which said sensor is an optical sensor with a line of sight passing through an upper and forward portion of a bowling ball when the ball is on said cradle.

14. A bowling ball return mechanism according to claim 13 which includes circuit means for receiving a signal from said sensor and for actuating said clutch to rotatable said crank pulley through a single cycle.

15. A bowling ball return mechanism according to claim 14 in which said circuit means includes a time delay to prevent false triggers due to a flying pin.

16. A bowling ball return mechanism comprising a horizontal ball return having a ball entrance area, a ball exit area and means for propelling a ball along the length of a bowling alley disposed between said entrance and exit areas, said mechanism including a first pair of side walls defining a chamber therebetween, a concave cradle disposed within said chamber at a lower portion thereof and means defining an opening in one of said side walls for allowing a bowling ball to pass therethrough and onto said cradle, means including a sensor for producing a signal responsive to the geometric shape and size of a bowling ball when a bowling ball is in contact with said cradle, means for moving said cradle in response to a signal from said sensor to thereby deliver the ball to said entrance area for propulsion along the length of a bowling alley.

17. A bowling ball return mechanism according to claim 16 in which said sensor is responsive to an upper portion of the bowling ball.

18. A bowling ball return mechanism according to claim 12 which includes an exit door and means for releasing said exit door when an upper surface of a bowling ball comes into contact therewith as the ball is moved by said cradle.

19. A bowling ball return mechanism according to claim 18 which includes pivot means adjacent to said cradle and wherein said means for moving said cradle rotates said cradle about said pivot means.

20. A bowling ball return mechanism according to claim 18 which includes a locking member disposed above said cradle, said locking member having contact means so that it is contacted by an upper surface of the bowling ball as the ball is moved by said cradle to thereby unlock said exit door means.

21. A bowling ball return mechanism according to claim 16 in which said concave cradle defines a generally flat but crescent-shaped ball receiving surface.

22. A bowling ball return mechanism according to claim 21 wherein said concave cradle includes a pair of side walls extending rearwardly from said crescent-shaped surface for preventing pins from passing through the opening in the first pair of side walls as a bowling ball is being moved by said cradle.

23. A bowling ball return mechanism according to claim 22 which includes a pivotally mounted locking member.

24. A bowling ball return mechanism according to claim 23 which includes an exit door having a locking pin and wherein said locking member includes a groove for engaging said locking pin.

25. A bowling ball return mechanism according to claim 24 which includes oscillating paddle means between said first pair of side walls for preventing more than one bowling ball from entering said chambers at the same time and for removing fallen pins from said chamber.

26. A bowling ball return mechanism according to claim 25 which includes clutch assembly means which is responsive to a signal from said sensor for activating said cradle.

27. A bowling ball return mechanism in accordance with claim 26 which includes a pivot means, crank pulley and linkage connecting said cradle to said crank pulley through said pivot means whereby rotation of said crank pulley moves said cradle about said pivot means.

28. A bowling ball return mechanism according to claim 27 in which said sensor is an optical sensor with a line of sight passing through an upper portion of a bowling ball when the ball is on said cradle.

29. A bowling ball return mechanism comprising a horizontal ball return having a ball entrance area, a ball exit area and means for propelling a ball along the length of a bowling alley disposed between said entrance and exit areas, said mechanism including a first pair of side walls defining a chamber therebetween, a pivotally mounted concave cradle disposed on a pivot within said chamber adjacent to and above said ball entrance area, and means defining an opening in one of said side walls adjacent to said cradle for allowing a bowling ball to pass therethrough and onto said cradle, means including a sensor for producing a signal when a bowling ball is in contact with said cradle, track means extending downwardly to said ball entrance area for receiving a bowling ball from said cradle and delivering the bowling ball into said entrance area and means for rotating said cradle about said pivot in response to a signal from said sensor to thereby deliver a bowling ball to said entrance area for propelling it along the length of a bowling alley.

30. A bowling ball return mechanism for use with a pin spotter according to claim 29 which includes exit door means for preventing pins from being delivered to said ball entrance area and a releasable locking assembly means for locking said exit door in a closed position and which is released by an upper surface of a bowling ball coming into contact therewith as the ball is moved by said cradle.

31. A bowling ball return mechanism in accordance with claim 30 in which said locking member is disposed above said cradle so that it is contacted by an upper surface of the bowling ball as the ball is moved by said cradle to thereby unlock said exit door means.

32. A bowling ball return mechanism according to claim 31 in which said concave cradle defines a generally crescent-shaped ball receiving surface.

33. A bowling ball return mechanism according to claim 32 wherein said concave cradle includes a pair of side walls extending rearwardly from said crescent-shaped surface for preventing pins from passing through the opening in one side of the first pair of side walls as a bowling ball is being moved by said cradle.

34. A bowling ball return mechanism according to claim 33 wherein said locking member is pivotally mounted.

35. A bowling ball return mechanism according to claim 34 which includes an exit door having a locking pin and wherein said locking member includes a groove for engaging said locking pin.

36. A bowling ball return mechanism according to claim 35 which includes oscillating paddle means between said first pair of side walls for preventing more than one bowling ball from entering said chamber at the same time and for removing any fallen pins from said chamber.

37. A bowling ball return mechanism according to claim 36 which includes a clutch assembly means which is responsive to a signal from said sensor for activating said cradle.

38. A bowling ball return mechanism according to claim 37 in which said sensor is an optical sensor with a line of sight passing through an upper portion of a bowling ball when the ball is on said cradle.

39. A bowling ball return mechanism according to claim 38 which includes circuit means for receiving a signal from said sensor and for actuating said clutch to rotate said crank pulley through a single cycle.

40. A bowling ball return mechanism according to claim 31 in which said circuit means includes a time delay function to prevent the ball return mechanism from being activated by a flying pin or the like.

41. A bowling ball return mechanism comprising a horizontal ball return having a ball entrance area, a ball exit area and means disposed between said ball entrance and ball exit areas for projecting a bowling ball along the length of a bowling alley, said mechanism including means comprising a first pair of side walls for defining a chamber adjacent to said ball entrance area and said chamber having a first side wall with an opening of sufficient size to allow a bowling ball to pass therethrough, a crescent-shaped cradle adjacent to said opening for receiving a bowling ball thereon with a portion of one side of the bowling ball against said cradle, a sensor responsive to the size and shape of a bowling ball when the ball is supported by said cradle for producing a signal that a bowling ball is in contact with said cradle, means for moving said cradle in response to a signal from said sensor to move the ball toward said entrance area, exit door means for preventing pins from being delivered to said horizontal ball return adjacent to and between an opposite side of the bowling ball and said ball entrance area, and a releasable locking member for maintaining said exit door means in a closed position, means for releasing said locking member in response to contact by the bowling ball as the bowling ball is moved toward said entrance area so that the ball passes through the exit door means, into the entrance area of the horizontal ball return and is propelled thereby along the length of a bowling alley.

42. A bowling ball return mechanism according to claim 41 which includes a pivot between said first pair of side walls and with said cradle movable about said pivot for moving a bowling ball upwardly and forwardly toward said entrance area.

43. A bowling ball return mechanism according to claim 42 wherein said sensor is an optical sensor which directs a beam of light through the space which is occupied by an upper portion of a bowling ball when the ball is supported by said cradle.

44. A bowling ball return mechanism according to claim 43 wherein said locking member is disposed in an upper portion of said chamber above the level of a bowling ball when the bowling ball is supported by said cradle and wherein the pivotal movement of said cradle lifts the bowling ball into contact with said locking member to thereby release the locking member allowing said exit door means to open.

45. A bowling ball return mechanism according to claim 44 wherein the pivotal movement of said cradle pushes the bowling ball through said exit door means.

46. A bowling ball return mechanism according to claim 45 which includes downwardly sloping track means between said exit door means and said entrance area so that the ball delivery to the horizontal ball return is augmented by gravity.

47. A bowling ball return mechanism in accordance with claim 46 wherein an oscillating paddle means between said first pair of side walls clears pins from said chamber.

48. A bowling ball return mechanism in accordance with claim 47 wherein said cradle includes means for partially closing said ball opening to prevent bowling pins from entering said chamber as a bowling ball is moving forward toward said entrance area.

49. A bowling ball return mechanism in accordance with claim 48 wherein said releasable locking member is released by an upper surface of a bowling ball coming into contact therewith as the ball is moved by said cradle.

50. A bowling ball return mechanism according to claim 49 in which said concave cradle defines a ball receiving surface having a crescent-shaped cross-section.

51. A bowling ball return mechanism according to claim 50 wherein said concave cradle includes a pair of side walls extending rearwardly from said crescent-shaped surface for preventing pins from passing through the opening in the side wall as a bowling ball is being moved by said cradle.

52. A bowling ball return mechanism according to claim 51 wherein said locking member is pivotally mounted.

53. A bowling ball return mechanism according to claim 52 which includes a locking pin and wherein said locking member includes a groove for engaging said locking pin.

54. A bowling ball return mechanism according to claim 53 which includes a clutch assembly which is responsive to a signal from said sensor for activating said cradle.

55. A bowling ball return mechanism according to claim 54 which includes a crank pulley and linkage connecting said cradle to said crank pulley whereby rotation of said crank pulley moves said cradle about said pivot means.

56. A bowling ball return mechanism according to claim 55 which includes circuit means for receiving a signal from said sensor and for actuating said clutch to rotate said crank pulley through a single cycle.

57. A bowling ball return mechanism for returning spent bowling balls from two adjacent lanes at one end of a bowling alley to the opposite end thereof comprising a horizontal ball return disposed between the adjacent lanes and having an entrance area, an exit area, and means disposed between said ball entrance area and said ball exit areas for propelling a bowling ball along the length of the bowling alley said mechanism including means defining a chamber between the lanes and adjacent to said ball entrance area, and said chamber having first and second sidewalls each of which defines an opening of sufficient size to allow a bowling ball to pass therethrough, a concave cradle adjacent to said openings for receiving a bowling ball from either of the lanes thereon with a bottom portion and a portion of one side of the bowling ball against said cradle, a sensor responsive to the size and shape of the bowling ball when the bowling ball is supported by said cradle for producing a signal that a bowling ball is supported by said cradle, means for moving said cradle in response to a signal from said sensor to move the ball toward said entrance area, exit door means for preventing pins from being delivered to said horizontal ball return adjacent to and between an opposite side of the bowling ball and said ball entrance area, and a releasable locking means for maintaining said exit door means in a closed position, means for releasing said locking means in response to contact by the bowling ball as the ball is moved toward said entrance area so that the ball passes through the exit door means, into the entrance area of the horizontal ball return and is propelled thereby along the length of a bowling alley, and said mechanism further including oscillating paddle means between said first and second side walls for preventing more than a single bowling ball from entering said chamber at any given time.

58. A bowling ball return mechanism according to claim 57 which includes a pivot with said cradle movable about said pivot for moving a bowling ball upwardly and forwardly toward said entrance area.

59. A bowling ball return mechanism according to claim 58 wherein said sensor is an optical sensor which directs a beam of light through the space which is occupied by an upper portion of a bowling ball when the ball is supported by said cradle.

60. A bowling ball return mechanism according to claim 59 wherein said locking means is disposed in an upper portion of said chamber above the level of an upper surface of a bowling ball when the bowling ball is supported by said cradle and wherein the pivotal movement of said cradle lifts the bowling ball into contact with said locking member to thereby release the locking function allowing said exit door means to open.

61. A bowling ball return mechanism according to claim 60 in which said locking means includes a locking pin and groove and wherein said locking means includes a pivotally mounted downwardly extending contact portion.

62. A bowling ball return mechanism according to claim 61 wherein the pivotal movement of said cradle pushes the bowling ball through said exit door means.

63. A bowling ball return mechanism according to claim 62 which includes downwardly sloping track means between said exit door means and said entrance area of said horizontal ball return so that the ball delivery is augmented by gravity.

64. A bowling ball return mechanism in accordance with claim 63 wherein said cradle includes means for partially closing said ball opening to prevent bowling pins from entering said chamber as a bowling ball is moved toward said entrance area.

65. A bowling ball return mechanism in accordance with claim 64 wherein said releasable locking assembly is released by an upper surface of a bowling ball coming into contact therewith as the ball is moved by said cradle.

66. A bowling ball return mechanism according to claim 65 in which said concave cradle defines a ball receiving surface having a generally crescent-shaped cross-section.

67. A bowling ball return mechanism according to claim 66 wherein said concave cradle includes a pair of side walls extending rearwardly for preventing pins from passing through the opening in the side walls as a bowling ball is being moved by said cradle.

68. A bowling ball return mechanism according to claim 67 wherein said locking member is pivotally mounted.

69. A bowling ball return mechanism according to claim 68 which includes a locking pin and wherein said locking member includes a groove for engaging said locking pin.

70. A bowling bail return mechanism according to claim 69 which includes clutch assembly means which is responsive to a signal from said sensor for activating said cradle.

71. A bowling ball return mechanism according to claim 70 which includes a crank pulley and linkage connecting said cradle to said crank pulley whereby rotation of said crank pulley moves said cradle about said pivot means.

72. A bowling ball return mechanism according to claim 71 which includes circuit means for receiving a signal from said sensor and for actuating said clutch assembly means to rotate said crank pulley through a single cycle and time delay means for preventing actuation of said return mechanism in response to a flying pin.

73. A bowling ball return mechanism according to claim 57 which includes a ball door ring including an inwardly and slightly downwardly extending portion adjacent to each of said ball openings for forming a cup shaped ball support with said cradle.

74. A bowling bail return mechanism according to claim 73 in which said sensor is responsive to an upper forward portion of the bowling ball.

* * * * *